US006042107A

United States Patent [19]

Stephan et al.

[11] Patent Number: 6,042,107

[45] Date of Patent: Mar. 28, 2000

[54] DEVICE FOR CONTACT-FREE SHEET GUIDANCE IN A SHEET-FED PRINTING PRESS

[75] Inventors: Günter Stephan, Wiesloch-Baiertal; Peter Thoma, Mannheim, both of Germany

[73] Assignee: Heidelberger Druckmaschinen AG, Heidelberg, Germany

[21] Appl. No.: 08/922,424

[22] Filed: Sep. 3, 1997

[30] Foreign Application Priority Data

Sep. 3, 1996 [DE] Germany ..... 196 35 629

[51] Int. Cl.[7] ..... B65H 29/24

[52] U.S. Cl. ..... 271/195; 406/88

[58] Field of Search ..... 406/86, 88; 271/195

[56] References Cited

U.S. PATENT DOCUMENTS

| | | | |
|---|---|---|---|
| 3,633,281 | 1/1972 | Vits . | |
| 3,975,057 | 8/1976 | Hurd | 271/195 |
| 5,102,118 | 4/1992 | Vits . | |
| 5,466,096 | 11/1995 | Hilbish et al. | 406/88 |
| 5,803,448 | 9/1998 | Stiel et al. | 271/195 |
| 5,836,247 | 11/1998 | Stephan | 271/195 |

FOREIGN PATENT DOCUMENTS

| | | | |
|---|---|---|---|
| 789 419 | 7/1968 | Canada | 271/195 |
| 1907083 | 4/1975 | Germany . | |
| 2802610C2 | 5/1983 | Germany . | |
| 3936846C1 | 4/1991 | Germany . | |
| 4406848A1 | 9/1995 | Germany . | |
| 4427448A1 | 2/1996 | Germany . | |

*Primary Examiner*—H. Grant Skaggs
*Attorney, Agent, or Firm*—Herbert L. Lerner; Laurence A. Greenberg

[57] ABSTRACT

A device for contact-free sheet guidance in a sheet-fed printing press, having a sheet guiding surface and an air guiding surface directed obliquely away from the sheet guiding surface, includes at least one blast air nozzle disposed in the sheet guiding surface and having a cross section formed as a ring slot sector having a center of curvature located within an opening of the blast air nozzle formed in the plane of the sheet guiding surface.

4 Claims, 2 Drawing Sheets

DEVICE FOR CONTACT-FREE SHEET GUIDANCE IN A SHEET-FED PRINTING PRESS

BACKGROUND OF THE INVENTION

FIELD OF THE INVENTION

The invention relates to a device for contact-free sheet guidance in a sheet-fed printing press and, more particularly, to such a sheet guidance device having a sheet guiding surface, wherein there is provided at least one blast air nozzle having a cross section formed as a ring slot sector, and having an air guiding surface directed obliquely downwardly from the sheet guiding surface.

A sheet guidance device of this general type has become known heretofore from German Patent 19 07 083 wherein, in a guide baffle, blast air nozzles having a cross section in the form of a sector of a ring slot are provided in a surface of the guide baffle, and an air guiding surface is formed extending obliquely downwardly relative to the surface of the guide baffle, and defining the ring slot sector which is located opposite to the air guiding surface. The blast air nozzles of the conventional device shown in the German patent are provided with a guide baffle formed with punched or stamped-out tonguelike notches for producing a directionally focused airflow, with a shallow angle directed in the sheet-feeding direction towards the sheet to be transported which floats above the surface of the guide baffle. A geometrical bottleneck for the air flowing through the respective blast air nozzle is located at an air outlet location. This choke point is followed by a diverging guide surface acting as a diffuser and, in this region, a negative pressure typical for a diffuser is generated which sucks the sheet against the guide face formed by the tonguelike notches. Due to this suction, contact-free sheet guidance is no longer achieved. A consequence thereof is the occurrence of scratches, and smearing of the side of the sheet communicating with the guidance device. Comparable with the foregoing conventional device is the action of a device heretofore known from the published German Patent Document DE 41 13 465 A1.

SUMMARY OF THE INVENTION

It is accordingly an object of the invention to provide a device for contact-free sheet guidance in a sheet-fed printing press including blast air nozzles having the foregoing general characteristics wherein emerging blast or blown air does not have any negative pressure zones impeding uniform air flow under the sheet to be fed, and assures a contact-free sheet guidance.

With the foregoing and other objects in view, there is provided, in accordance with the invention, a device for contact-free sheet guidance in a sheet-fed printing press, having a sheet guiding surface and an air guiding surface directed obliquely away from the sheet guiding surface, comprising at least one blast air nozzle disposed in the sheet guiding surface and having a cross section formed as a ring slot sector having a center of curvature located within an opening of the blast air nozzle formed in the plane of the sheet guiding surface.

In accordance with another feature of the invention, the center of curvature is located on the air guiding surface.

In accordance with a further feature of the invention, the sheet guiding surface is a surface of a guide plate, and the air guiding surface defines the ring slot sector of the sheet guiding surface of the guide plate opposite thereto.

In accordance with an added feature of the invention, the blast air nozzle is formed by a U-shaped notch defined by a tonguelike deformation of the guide plate, and the air guiding surface in the region of the notch.

In accordance with a concomitant feature of the invention, the air guiding surface and the sheet guiding surface, in a cross-sectional plane substantially perpendicular to the sheet travel direction, enclose an obtuse angle.

In a device having the foregoing structural features, the blast air nozzles formed in the sheet guiding surface have the cross section of an annular gap or ring slot sector, which is defined by an air guiding surface extending obliquely downwardly from the sheet guiding surface.

Due to the structural features of the invention, a flow develops which is directed within the nozzle opening towards a point of the air guiding surface in the plane of the sheet guiding surface. Thus the slot opening no longer acts alone as a choke point for the air flow. Instead, a fluidic bottleneck is created in a region around the point at which the air flow is focused. At this point, however, flow components directed counter to one another are effective, so that an overpressure or excess pressure effect compensates for the typical diffuserlike pressure reduction downstream from the negative pressure zone of the choke point which defines the annular gap or ring slot sector and at least limits the pressure reduction to a minimal region which is no longer effective on the air flow under the sheet to be transported.

Other features which are considered as characteristic for the invention are set forth in the appended claims.

Although the invention is illustrated and described herein as embodied in a device for contact-free sheet guidance in a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
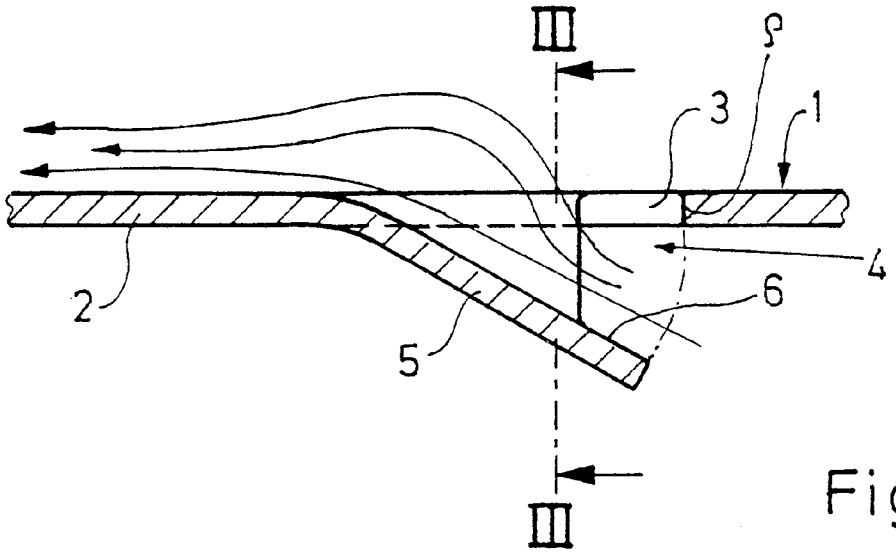
FIG. 1 is a longitudinal sectional view, parallel to a sheet travel direction, of a blast air nozzle with an air guiding surface formed by recessing a tonguelike notch.

Referring now to the drawings and, first, particularly to FIG. 1 thereof, there is shown therein a contact-free sheet guidance device having a sheet guiding surface 1 formed on a guide plate 2 and providing contact-free sheet guidance by floating a sheet on an air cushion formed thereon. In this guide plate 2, blast air nozzles 3 are disposed, which are spaced apart from one another and distributed over the sheet guiding surface 1. In the embodiment of the invention shown in FIG. 1, each blast air nozzle 3, only one of which is illustrated in the figure, is supposed to be formed by a tonguelike notch 4 incised in the guide plate 2, the notch 4 widening with divergent section lines in the direction of the sheet travel, as shown in the plan view of FIG. 2. The tongue 5 formed by the notch 4 is bent out of the plane of the guide plate 2 transversely to the sheet guiding surface 1 and forms an air guiding surface 6 rising towards the sheet guiding surface 1. Preferably, a notch opening, i.e., a ring slot or annular gap sector ρ, radially extending around the focus is provided, terminating at arc elongating legs and merging thereat into a deformation of the guide plate or baffle 2 towards the tongue 5 formed with the air guiding surface 6. In another embodiment of the invention, it is possible to provide a notch as in FIG. 2 which has divergent legs joined together by an arc. This construction results in a blast air nozzle formed as an annular gap or ring slot sector having a center 7 located downstream in the air flow direction from the outlet opening. The annular gap sector thus forms an outlet opening which is disposed in or upstream of a confusor or convergent region 8. Adjoining the confusor region 8, the air is guided to the guide plate or baffle 2 via a diffuser or divergent region 9. The negative pressure zone, which is not absolutely avoidable physically, is limited to an extremely small region at the opening gap of the nozzle. Immediately downstream of this negative pressure zone, excess pressure is built up in the inflow zone due to the shape of the blast air nozzle, the effect of the negative pressure being compensated for to a great extent.

Figure 2:
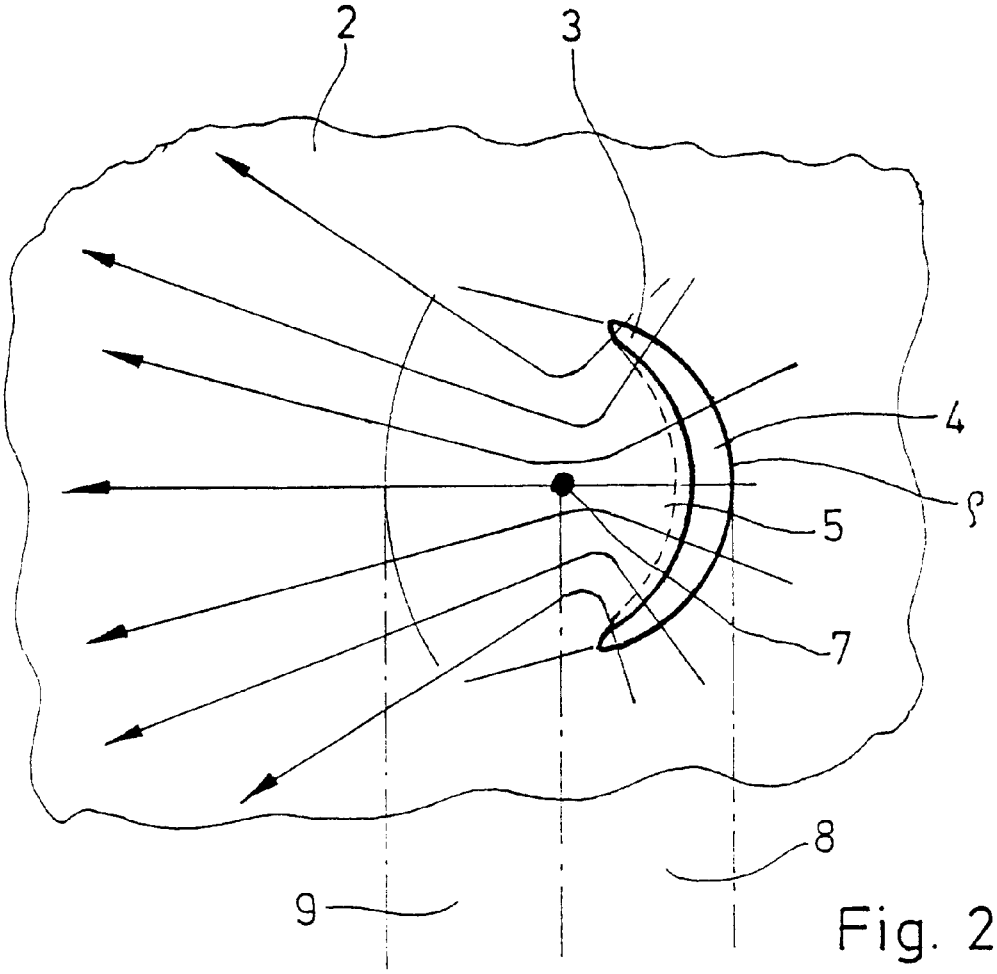
FIG. 2 is a plan view of FIG. 1.
Figure 3:
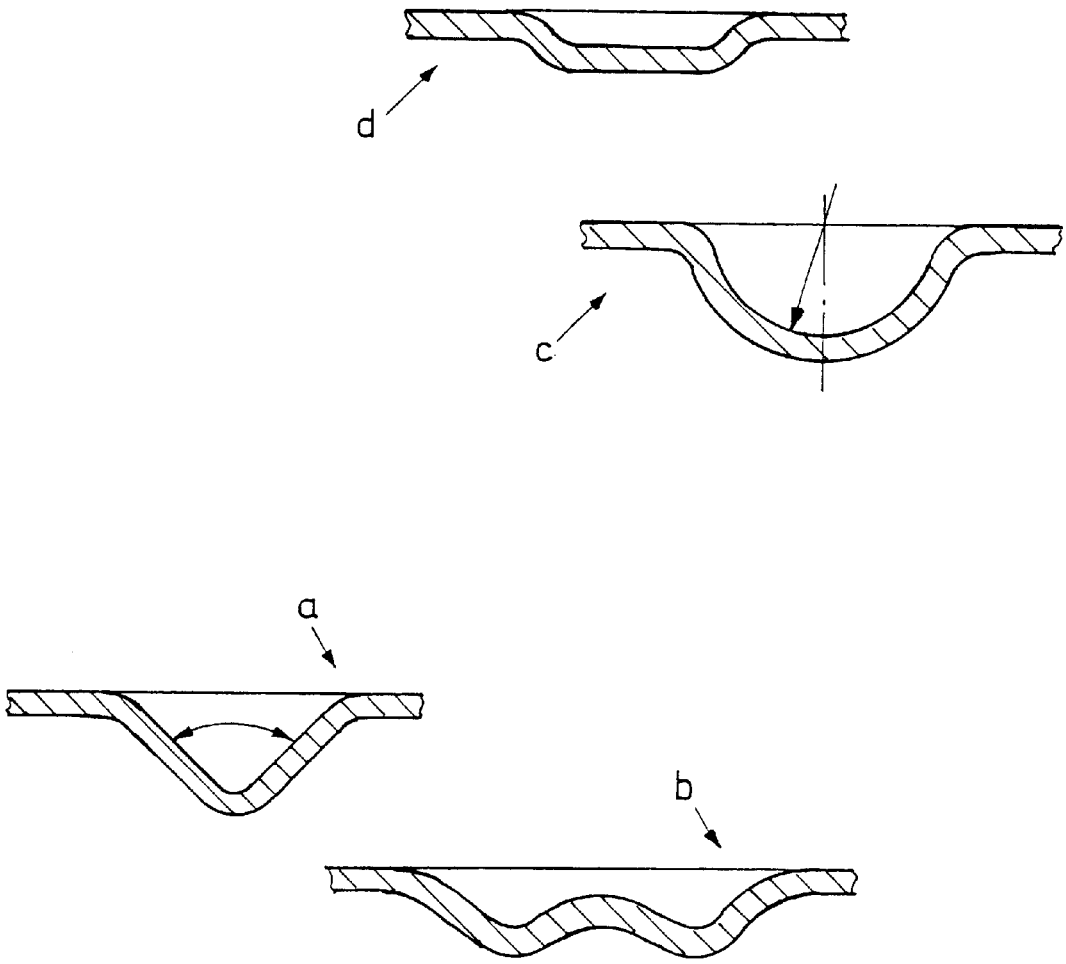
FIGS. 3*a* to 3*d*, respectively, are a cross-sectional view of FIG. 1 taken along the line III—III in the direction of the arrows, and showing various embodiments of the blast air nozzle having different cross sections.

In the cross-sectional plane III—III of FIG. 1, the tongue-like notch 4 may have different cross-sectional contours. Some examples thereof are shown in FIGS. 3*a*, 3*b*, 3*c* and 3*d*, and an adaptation of these cross-sectional contours to various requirements can be made. In FIG. 3*a*, a V-shaped cross-sectional profile of the blast air nozzle in the sectional plane III—III of FIG. 1 is illustrated. FIG. 3*b* shows an undulating or wavelike contour in the cross-sectional plane III—III. In comparison therewith, the cross-sectional contour in FIG. 3*c* is arcuate. FIG. 3*d* shows a shallow outward bulge of the tongue part with a flat middle region extending approximately equidistant from the sheet guiding surface 1. Instead of the notch 4 with diverging legs having an arcuate contour, as shown in FIG. 2, the notch 4 may optionally be V- or U-shaped in plan view, in order to attain the sought-after goal.

We claim:

1. A device for contact-free sheet guidance in a sheet-fed printing press, comprising:

a sheet guiding surface; and an air guiding surface extending obliquely away from said sheet guiding surface and forming an opening defining an air blast nozzle in said sheet guiding surface, said air guiding surface having an arc-shaped end remote from said sheet guiding surface, said arc-shaped end having a center of curvature located on said air guiding surface within the opening, and said air guiding surface having opposing arc elongating edges diverging from one another while extending from said arc-shaped end to said sheet guiding surface.

2. The guidance device according to claim 1, wherein the sheet guiding surface is a surface of a guide plate.

3. The guidance device according to claim 2, wherein said blast air nozzle is formed by a U-shaped notch defined by a tonguelike deformation of the guide plate and the air guiding surface in the region of the notch.

4. The guidance device according to claim 3, wherein the air guiding surface and the sheet guiding surface, in a cross-sectional plane substantially perpendicular to the sheet travel direction, enclose an obtuse angle.

* * * * *